US005474038A

United States Patent [19]

Golovatai-Schmidt et al.

[11] Patent Number: 5,474,038

[45] Date of Patent: Dec. 12, 1995

[54] DEVICE FOR CONTINUOUS AUTOMATIC ANGULAR ADJUSTMENT BETWEEN TWO SHAFTS IN DRIVING RELATIONSHIP

[75] Inventors: Eduard Golovatai-Schmidt, Nuremberg; Gerhard Weigmann, Pulheim, both of Germany

[73] Assignee: Ina Walzlager Schaeffler KG, Germany

[21] Appl. No.: 313,290

[22] PCT Filed: May 17, 1993

[86] PCT No.: PCT/EP93/01223

§ 371 Date: Oct. 3, 1994

§ 102(e) Date: Oct. 3, 1994

[87] PCT Pub. No.: WO93/24737

PCT Pub. Date: Dec. 9, 1993

[30] Foreign Application Priority Data

Jun. 1, 1992 [DE] Germany ..... 42 18 078.3

[51] Int. Cl.[6] ..... F01L 1/34

[52] U.S. Cl. ..... 123/90.17; 123/90.31; 464/2; 74/568 R

[58] Field of Search ..... 123/90.12, 90.13, 123/90.15, 90.17, 90.31; 464/1, 2, 160; 74/567, 568 R

[56] References Cited

U.S. PATENT DOCUMENTS

| | | | |
|---|---|---|---|
| 4,762,097 | 8/1988 | Baker | 123/90.31 |
| 5,144,921 | 9/1992 | Clos et al. | 123/90.17 |
| 5,170,756 | 12/1992 | Szodfridt | 123/90.17 |
| 5,189,999 | 3/1993 | Thoma | 123/90.17 |
| 5,209,194 | 5/1993 | Adachi et al. | 123/90.17 |
| 5,301,639 | 4/1994 | Satou | 123/90.17 |
| 5,329,890 | 7/1994 | Mueller | 123/90.17 |

FOREIGN PATENT DOCUMENTS

| | | |
|---|---|---|
| 0147209 | 7/1985 | European Pat. Off. . |
| 855158 | 5/1940 | France . |
| 2668538 | 4/1992 | France . |
| 3929621 | 3/1991 | Germany . |

*Primary Examiner*—Henry C. Yuen
*Assistant Examiner*—Weilun Lo
*Attorney, Agent, or Firm*—Bierman and Muserlian

[57] ABSTRACT

A device for angular adjustment between at least two shafts, a crankshaft and a cam shaft, in driving relationship in an internal combustion engine, comprising an adjusting element arranged in a region of a cylinder head and connected to the camshaft while being arranged in an axial direction thereof, the adjusting element comprising a piston which is displaceable between two substantially circular ring-shaped pressure chambers which are connected to a source of pressure medium, characterized in that a separate oil distributing element (16) is rigidly integrated in a cap (27) of the adjusting element (3) arranged at a front end of the camshaft (5) and said oil distributing element (16) comprises ducts (6,7) for pressure medium supply oriented towards the piston (14) which comprises two piston areas of identical dimensions.

7 Claims, 2 Drawing Sheets

DEVICE FOR CONTINUOUS AUTOMATIC ANGULAR ADJUSTMENT BETWEEN TWO SHAFTS IN DRIVING RELATIONSHIP

The invention concerns a device for automatic angular adjustment between two shafts in driving relationship.

Camshafts used in internal combustion engines actuate the engine valves in keeping with the profile of their cams. Fixed valve timings constitute a compromise particularly with regard to requirements concerning rated output and torque. The use of phase shifting to optimize valve timings is known. In an internal combustion engine with double camshafts this means that the position of the camshaft for the inlet or the exhaust valves is displaced with respect to the crankshaft by a certain crank angle which results in a change in the valve lap of the inlet and exhaust valves.

A device for the angular adjustment of a camshaft is known from DE-A 39 29 621. A drive gear of this adjusting device is made in one piece with a hollow hub which is mounted for angular displacement with its outer periphery in an outer recess of the shaft. The hollow hub cooperates by means of a helical gearing with a coupling member which is rigidly connected via a guide member to the camshaft in an inner recess thereof. To obtain a relative angular displacement of the camshaft with respect to the drive gear, the coupling member is axially displaceable being connected by a coupling rod to a hydraulic piston. A cylinder which is releasably mounted in the cap serves as a guide for the piston. This cylinder which is arranged in a stepped bore comprises circumferentially spaced openings on its pressure and suction ends. The arrangement of the piston results in two differently dimensioned piston areas which give rise to different adjusting speeds of the piston under the same pressure and are particularly disadvantageous in rapid switching operations.

A valve control for inlet valves is known from the species defining document, DE-C 38 10 804, in which the inlet camshaft can be adjusted with the help of a phase transformer. An adjusting element is mounted for axial displacement and comprises an exclusively hydraulically actuatable piston which is associated with two working chambers and controlled by an adjusting piston of a directional control valve. This adjusting piston is displaced between two discrete end positions by a solenoid switch which is arranged on the produced longitudinal axis of the camshaft and therefore increases the axial design space requirement of the engine. A pressure medium can be applied to both ends of the piston of the adjusting element and is fed to the adjusting element through a partially bored-open camshaft. The adjusting element is arranged between the camshaft and the driving gear of the camshaft and comprises a helical internal gearing and a helical external gearing with identical but oppositely oriented helix angles cooperating with appropriate gearings on the camshaft and the driving gear of the camshaft. This construction, particularly the control valve, permits only a two-point adjustment of the inlet camshaft. The extra design space required due to the chosen arrangement of the solenoid is disadvantageous particularly when the engine is installed crosswise. Moreover, the supply of pressure medium through the camshaft necessitates a special structural configuration and mounting of the camshaft in order to avoid an influence on the strength of the camshaft and the lubrication at mounting parts.

A further device for the angular adjustment of a camshaft is known from EP-A 01 63 046 in which an arrangement for feeding a pressure medium to a hydraulic adjusting device is located in a camshaft in the mounting region thereof. The housing in which the camshaft is mounted comprises oil bores through which the hydraulic oil is transported in the radial direction in the mounting region of the camshaft and via peripheral grooves into the camshaft. The hydraulic oil is transferred through tap bores into axially extending bores of the camshaft and from there to the adjusting piston. This construction requires a special camshaft structure as also appropriate aligning measures for the pressure medium feeding arrangement which have the disadvantage of being complicated and cost-intensive and increase design space requirement.

The object of the invention is to provide a device in which the supply of pressure medium to the adjusting element is separate from the camshaft and the mounting thereof while being efficient and having favorable flow characteristics to improve the application of pressure to the piston and the reaction capacity thereof.

The invention achieves this object by the fact that a separate oil distributing element is rigidly integrated in a cap of the adjusting element arranged at a front end of the camshaft and said oil distributing element comprises ducts for pressure medium supply oriented towards the piston which comprises two piston areas of identical dimensions, The measures proposed by the invention advantageously result in an optimized, efficient supply of pressure medium for the hydraulic piston whereby the reaction capacity of the adjusting device can be improved and the switching hysteresis positively influenced. The use of a separate oil distributing element results in favorable flow characteristics of the pressure medium supply to the pressure chambers between which the piston is displaceable. According to the invention, two axially separated ducts enter the adjusting element from an end face thereof facing away from the camshaft, This advantageously results in a pressure supply which is efficient and completely separate from the camshaft while possessing favorable flow characteristics and having no adverse effect on the camshaft mounting or the fabrication thereof.

In a development of the invention, the device of the invention comprises a bushing which is rigidly secured on the camshaft and on whose peripheral surface the piston is guided for axial displacement. In axial extension of the camshaft, the bushing coaxially covers a part of the oil distributing element and permits oil transfer at at least one location between an annular canal of the oil distributing element and a pressure chamber through circumferentially spaced bores, To effectively seal the location of oil transfer, sealing rings are provided on either side of the annular canal between the oil distributing element and the bushing.

For obtaining a compact construction, there is provided at one end of the camshaft a bush-type, rigidly fixed housing on which a dynamically balanced housing in the form of a hollow body is secured and lodges all the rotating components of the adjusting element. Another function of the housing is to form an outer guide for the hydraulic piston and to limit the two pressure chambers radially outwardly.

According to a further development of the invention, the adjusting stroke of the piston is limited in both axial directions by stops arranged in the region of the outer periphery of the piston plate to bear against the inner surface of the housing. The stop ring nearer to the camshaft has a stepped configuration, a pressure spring being supported on a step of the stop ring axially offset with respect to the step forming the piston stop. The adjusting element is surrounded by a cap rigidly secured on the cylinder head and mated with the contour of the adjusting element. The oil distributing element is centrally lodged in this cap which further comprises a web wall in which ducts for pressure medium supply are integrated.

Advantageously, the adjusting element is configured so that no special angular orientation of the individual parts associated with one another is required for assembly so that this is advantageously cost-effective and mounting errors are avoided.

A conical pressure spring is inserted between the piston plate and a stop ring for the hydraulic piston. The larger diameter region of the pressure spring surrounds the portion of the piston comprising the helical gearing and the component connected thereto. This permits the spring to have a larger spring length.

BRIEF DESCRIPTION OF THE DRAWINGS

FIGS. 1 and 2 show longitudinal cross-sections of a device of the invention in which the adjusting element 3 arranged in axial extension of the camshaft 5 projects laterally out of the cylinder head 2 and is covered with a cap 27. One end of a bushing 13 arranged in axial extension of the camshaft 5 concentrically surrounds an end region of the camshaft 5 while an opposite end of the bushing 13 surrounds the oil distributing element 16 which is mounted centrally and rigidly in the cap 27. The bushing 13 comprises in a central region thereof an inner web 48 which comprises a bore for receiving a screw 45 by which, in the installed slate and with the help of the abutment 47, the bushing 13 is rigidly fixed to and force engaged with the camshaft 5.

The piston 14 is arranged coaxially around the bushing 13, a part of the piston wall being spaced therefrom. The drawings show the piston 14 in its two end positions. FIG. 1 shows the piston 14 in a neutral position wherein no adjustment takes place, while the piston position shown in FIG. 2 corresponds to the maximum adjustments. The piston 14 comprises two gearings 18, 19. The gearing 18 establishes a connection between the piston 14 and the bushing 13 and the gearing 19 connects the piston 14 to a ring 21 which coaxially surrounds a part of the piston 14. The end of the piston 14 facing the cylinder head 2 forms a gap seal 39 between the bushing 13 and the piston 14. The piston 14 and all rotating parts of the adjusting element 3 are enclosed in the housing 20 which is enlarged radially outwards in two steps and rigidly connected to the housing 31. The free end of the housing 20 is closed by the annular disc 28 whose outer periphery is retained sealed in the housing 20. The annular disc 28 is arranged rotatably on the bushing 13 and sealed by the sealing ring 41. The stroke of the axially displaceable piston 14, whose piston plate 17 separates the pressure chambers 11 and 12 from one another, is limited by circular ring-shaped stops 25, 26 arranged on either side of the piston in the region of the radially outer periphery of the piston plate 17. In the pressureless state, the piston 14 is displaced by a pressure spring 24 against the stop 26. Pressure increase in the pressure chamber 11 is effected by a pressure medium supplied through the duct 6 located in the oil distributing element 16, which oil is transferred further through the tap bore 43 into the annular canal 42 which is made radially in the outer periphery of the oil distributing element 16. From there, the oil flows through one of several identical bores 40 of the bushing 13 into the pressure chamber 11 which has a substantially circular ring-shaped contour and is delimited laterally by the annular disc 28 and the piston plate 17. On either side of the region of oil transfer between the oil distributing element 16 and the bushing 13 there is arranged a sealing ring 9, 10. The pressure medium supply to the pressure chamber 12 is effected through the duct 7 likewise located in the oil distributing element 16. Oil from the duct 7 flows via the recess 44 into the free space 46 which extends between the recess 44 and the inner web 48 and from there, via the recess 36 and the bore 37 of the inner web 48, into the groove 35 whereby the oil is diverted radially outwards into the region between the bushing 13 and the ring 21. The pressure medium then passes through the gear pair 19, in which individual teeth are omitted to improve flow, and subsequently into the pressure chamber 12 which is laterally delimited by the stop ring 25 and the piston plate 17. The sealing of the piston 14 is effected by a piston ring 38 which inserted into an annular radial groove on the outer periphery of the piston plate 17. The adjusting element 3 is configured so that the driving impulse, for example from a chain drive, acts on the pinion 32 which is rigidly connected to the housing 31. Due to a mounting gap 34 the pinion 32 can rotate relative to the camshaft 5 on a step thereof. On the end of the housing 31 away from the pinion 32, there is arranged the radially outwards enlarged two-stepped housing 20. Together with the flange 33, the first step of the housing 20 fixes the adjusting element 3 axially in the housing of the cylinder head 2. The adjusting element 3 is inserted into the cap 27 which constitutes a housing and comprises a web wall 22 which extends vertically downwards with respect to the oil distributing element 16 and has connecting ducts 29, 30 inserted therein. These connecting ducts 29, 30 serve to transfer pressure medium from the electrohydraulic valve 23—which is coupled for example with the pressure circulating lubrication of the internal combustion engine—to the ducts 6, 7.

Due to this configuration of the web wall 22, a short, stiff pressure medium passage located inside a housing is obtained between the electrohydraulic valve 23 and the adjusting element 3.

Mode of operation of the adjusting element

Figure 1:
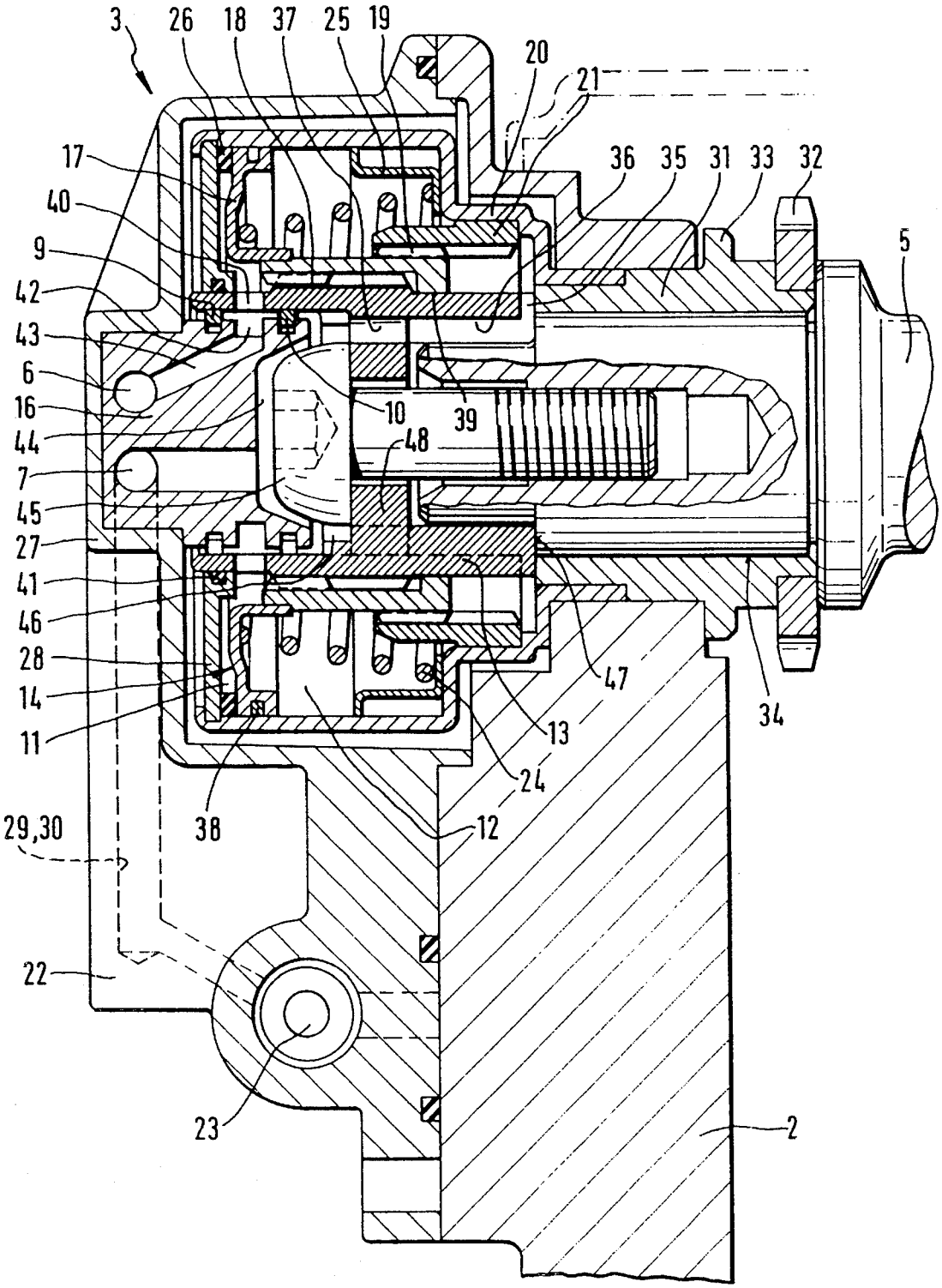
FIG. 1 is a semi-section of a device of the invention showing a piston position corresponding to the neutral position of the device.
Figure 2:
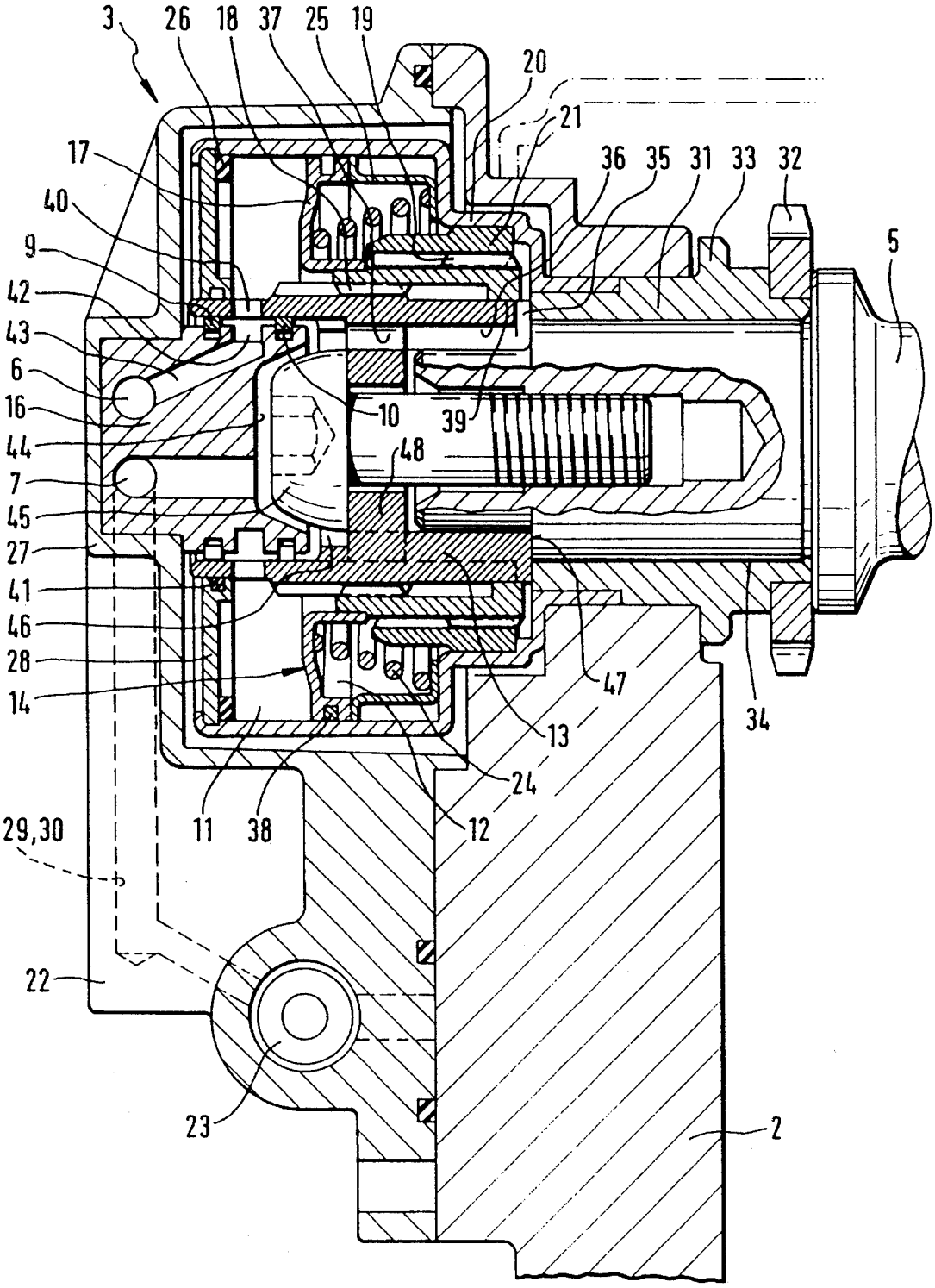
FIG. 2 is a partial cross-section of the device of FIG. 1 with the piston in a position corresponding to the maximum adjustment possible with the device.

When the pressure in the pressure chamber 11 is increased, the piston 14, starting from the position shown in FIG. 1, overcomes the force of the pressure spring 24 and is displaced towards the cylinder head 2 into and end position corresponding to that shown in FIG. 2. Due to the helical gearing of the gear pair 18 the displacement of the piston 14 is accompanied by a relative rotation between the piston 14 and the bushing 13. By the action of the gear pair 19 by which the piston 14 is connected to the ring 21 and thus also to the housings 20 and 31, a synchronous, boostering relative rotation takes place between the bushing 13 and the housing 31 and effects a change in the angular position of the driving element i.e. the pinion 32 relative to the camshaft 5 which is rigidly connected to the bushing 13.

We claim:

1. A device for angular adjustment between at least two shafts, a crankshaft and a cam shaft, in driving relationship in an internal combustion engine, comprising an adjusting element arranged in a region of a cylinder head and connected to the camshaft while being arranged in an axial direction thereof, the adjusting element comprising a piston which is displaceable between two substantially circular ring-shaped pressure chambers which are connected to a source of pressure medium, characterized in that a separate oil distributing element (16) is rigidly integrated in a cap (27) of the adjusting element (3) arranged at a front end of the camshaft (5) and said oil distributing element (16)

comprises ducts (6,7) for pressure medium supply oriented towards the piston (14) which comprises two piston areas of identical dimensions.

2. A device of claim 1 wherein a bushing (13) which is rigidly secured on the camshaft (5), and on whose peripheral surface the piston (14) is guided for axial displacement, coaxially covers a part of the oil distributing element (16) and forms at least one location of oil transfer between an annular canal (42) of the oil distributing element (16) and a pressure chamber (11), sealing rings (9, 10) being arranged on both sides of the annular canal (42) to seal the location of oil transfer.

3. A device of claim 1 wherein the camshaft (5) comprises at one end thereof a bush-type housing (31) on which a dynamically balanced housing (20) of sheet metal is secured which surrounds all rotating components of the adjusting element (3) and a piston plate (17) is guided in the housing (20).

4. A device of claim 1 wherein adjusting strokes of the piston (14) are limited by stops (25, 26) against which the piston plate (17) bears in end positions of the piston (14), a coil spring (24) being supported on a stop ring (25) which has a stepped configuration.

5. A device of claim 1 wherein the cap (27) which is secured on the cylinder head (2) surrounds all components of the adjusting element (3) which protrude beyond an outer contour of the cylinder head (2), said cap (27) further comprising a web wall (22) in which connecting ducts (29, 30) for supply of pressure medium are arranged.

6. A device of claim 1 wherein a conical coil spring (24) is inserted between the piston plate (17) and a support formed by the stop (25) nearer to the camshaft (5).

7. A device of claim 1 wherein no special angular orientation of individual components of the adjusting element (3) is required for assembly.

* * * * *